US010088279B2

(12) United States Patent
Hoy, Jr.

(10) Patent No.: US 10,088,279 B2
(45) Date of Patent: Oct. 2, 2018

(54) TARGET SYSTEM

(71) Applicant: James A. Hoy, Jr., Attica, NY (US)

(72) Inventor: James A. Hoy, Jr., Attica, NY (US)

( * ) Notice: Subject to any disclaimer, the term of this patent is extended or adjusted under 35 U.S.C. 154(b) by 0 days.

(21) Appl. No.: 15/849,972

(22) Filed: Dec. 21, 2017

(65) Prior Publication Data

US 2018/0195840 A1 Jul. 12, 2018

Related U.S. Application Data

(60) Provisional application No. 62/443,033, filed on Jan. 6, 2017.

(51) Int. Cl.
*F41J 1/10* (2006.01)
*F41J 7/04* (2006.01)
*F41J 5/18* (2006.01)

(52) U.S. Cl.
CPC . *F41J 1/10* (2013.01); *F41J 5/18* (2013.01); *F41J 7/04* (2013.01)

(58) Field of Classification Search
CPC ..... F41J 7/04; F41J 1/10
USPC ..... 273/390–392
See application file for complete search history.

(56) References Cited

U.S. PATENT DOCUMENTS 1,754,030 A * 4/1930 Mattson ..... F41J 5/18 273/391
2,561,733 A * 7/1951 Foyst ..... F41J 7/04 273/388
3,411,784 A * 11/1968 Lawrence ..... F41J 7/04 273/388
3,844,559 A * 10/1974 Davidson ..... F41J 7/04 273/127 D
4,550,918 A * 11/1985 Motsenbocker ..... F41J 7/04 273/385
4,911,453 A 3/1990 Essex et al.
4,949,980 A * 8/1990 Hoy ..... F41J 7/04 273/391
5,263,722 A * 11/1993 Rosellen ..... F41J 7/04 273/391
5,324,043 A * 6/1994 Estrella ..... F41J 7/04 273/391
5,342,062 A * 8/1994 Lance ..... F41J 1/10 273/391
6,347,798 B1 * 2/2002 Quiring ..... F41J 7/04 273/391
6,398,215 B1 6/2002 Carroll
(Continued)

OTHER PUBLICATIONS

Salute Targets, "Military Targets", https://www.salutetargets.com/military/index, retrieved May 24, 2017.
(Continued)

*Primary Examiner* — Mark Graham
(74) *Attorney, Agent, or Firm* — Hodgson Russ LLP

(57) ABSTRACT

A mechanical target system is disclosed, including a frame; a target rotatably connected to the frame; a reset rotatably connected to the frame; a locking system configured to hold the target in a locked position; and an unlocking system configured to release the target from the locked position. Contacting the target can move the target from an unlocked position to the locked position. Contacting the reset can move the target from the locked position to the unlocked position.

13 Claims, 16 Drawing Sheets

(56) References Cited

U.S. PATENT DOCUMENTS

| | | | | |
|---|---|---|---|---|
| 6,502,820 | B2 * | 1/2003 | Slifko | F41J 7/04 273/391 |
| 6,896,267 | B1 * | 5/2005 | Le Anna | F41J 7/04 273/391 |
| 6,983,938 | B2 * | 1/2006 | Goldsmith | F41J 7/04 273/391 |
| 6,991,233 | B2 * | 1/2006 | Goldsmith, Jr. | F41J 7/04 273/392 |
| 7,306,229 | B2 * | 12/2007 | Rolfe | F41J 7/04 273/391 |
| 7,422,216 | B1 * | 9/2008 | Underhill | F41J 7/04 273/392 |
| 7,731,197 | B2 * | 6/2010 | Stutz | F41J 7/04 273/392 |
| 2008/0023915 | A1 | 1/2008 | Morrow et al. | |

OTHER PUBLICATIONS

Salute Targets, "Law Enforcement", https://www.salutetargets.com/law-enforcernent/index, retrieved May 24, 2017.
Salute Targets, "Recreational Targets", https://www.salutetargets.com/recreational/index, retrieved May 24, 2017.
Custom Steel Targets, "Custom Designed Steel Shooting Targets", http://www.customsteeltargets.com, retrieved May 24, 2017.
Salute Targets, "Law Enforcement", https://www.salutetargets.com/law-enforcement/index, retrieved May 24, 2017.
Soldier Systems, "Autonomous Alloys—Digital Steel Smart Target System", http://soldiersystems.net/2016/06/27/autonomous-alloys-digital-steel-smart-target-system, retrieved May 24, 2017.

* cited by examiner

40

Detail A
121
122
11
1
11
122
121
11
100

Rear perspective view

Detail A

Front perspective view

Section A-A

P-2

Section A-A

Section B-B

PARTS LIST

| Part Name | Quantity | Dimensions | Material |
|---|---|---|---|
| Leg | 4 | 40" long x 1.5" x 16 gauge | Box Tubing |
| Cross Member | 1 | 48" long x 1.5" x 16 gauge | Box Tubing |
| Connection Bracket | 2 | 6" long x 1.75" wide x 2.50" tall | |
| Leg Locking Bar | 2 | 14" long x 1.25" wide | |
| Target Release Cam | 4 | 3" diameter | |
| Target Cam | 4 | 3" diameter | |
| Reset Cam | 1 | 3" x 1.75" | |
| Release Cam | 1 | 3" x 1.75" | |
| Target Pin | 4 | 5" long x .50" diameter | Stainless Steel |
| Target Pin Sleeve | 4 | 2" long x .75" (outer diameter) x .51" (inner diameter) | Seamless Tubing |
| Reset Pin | 1 | 4" x .50" diameter | Stainless Steel |
| Reset Pin Sleeve | 1 | 2" long x .75" (outer diameter) x .51" (inner diameter) | Seamless Tubing |
| Second Tension Sleeve | 1 | 1" long x .75" (outer diameter) x .51" (inner diameter) | Seamless Tubing |
| Tension Pin | 1 | 3" x .50" diameter | Stainless Steel |
| Tension Spring | 1 | | |
| First Tension Sleeve | 1 | .75" long x .75" (outer diameter) x .51" (inner diameter) | Seamless Tubing |
| Retention Pin | 1 | .75" long x 5/32" diameter | |
| Target Shaft | 4 | 3.50" long | |
| Reset Shaft | 1 | 3.50" long | |
| Target | 4 | 9" long x 6" diameter x 3/8" thick | AR-555 Ballistic Plate |
| Reset | 1 | 16" long x 6" diameter x 3/8" thick | AR-555 Ballistic Plate |
| Target Support | 8 | 2.50" long x 1.50" wide | |
| Reset Support | 2 | 2.50" long x 1.50" wide | |
| Release Support | 5 | 2.50" long x 1.50" wide | |
| Release Shaft | 1 | 28" by .50" diameter | Stainless Steel |

FIG. 7

TARGET SYSTEM

CROSS-REFERENCE TO RELATED APPLICATIONS

This application claims priority to U.S. Provisional Application No. 62/443,033, filed on Jan. 6, 2017, now pending, the disclosure of which is incorporated herein by reference.

FIELD OF THE DISCLOSURE

The disclosure relates to target systems.

BACKGROUND OF THE DISCLOSURE

For recreational shooting, marksmen improve and test their accuracy by shooting at targets. For example, a marksman may shoot a plurality of targets in an arrangement, requiring the marksman to adjust their aim to hit every target. In most target systems, the marksman must manually reset the targets in the arrangement in order to shoot them again. This can be time consuming as well as dangerous if other marksmen are using target systems arranged nearby.

Electronic target systems exist which allow the marksman to reset the targets from a distance. However, these systems can be complicated, expensive, and require a power source. This can limit the the shooting environment to a location with a power source.

BRIEF SUMMARY OF THE DISCLOSURE

The present disclosure provides a mechanical target system, which can allow a user to reset the targets from a distance. The target system may include a frame, a target rotatably connected to the frame, a reset rotatably connected to the frame, a locking system configured to hold the target in a locked position, and an unlocking system configured to release the target from the locked position. The target system may be configured such that contacting the target moves the target from an unlocked position to the locked position, and contacting the reset moves the target from the locked position to the unlocked position.

The present disclosure provides a method of using the mechanical target system. The method may include contacting the target to move the target from an unlocked position to a locked position, and contacting the reset to move the target from the locked position to the unlocked position.

DESCRIPTION OF THE DRAWINGS

For a fuller understanding of the nature and objects of the disclosure, reference should be made to the following detailed description taken in conjunction with the accompanying drawings, in which:

FIG. 7 is a table of the materials and dimensions of the various components of the present disclosure;

DETAILED DESCRIPTION OF THE DISCLOSURE

Figure 1:
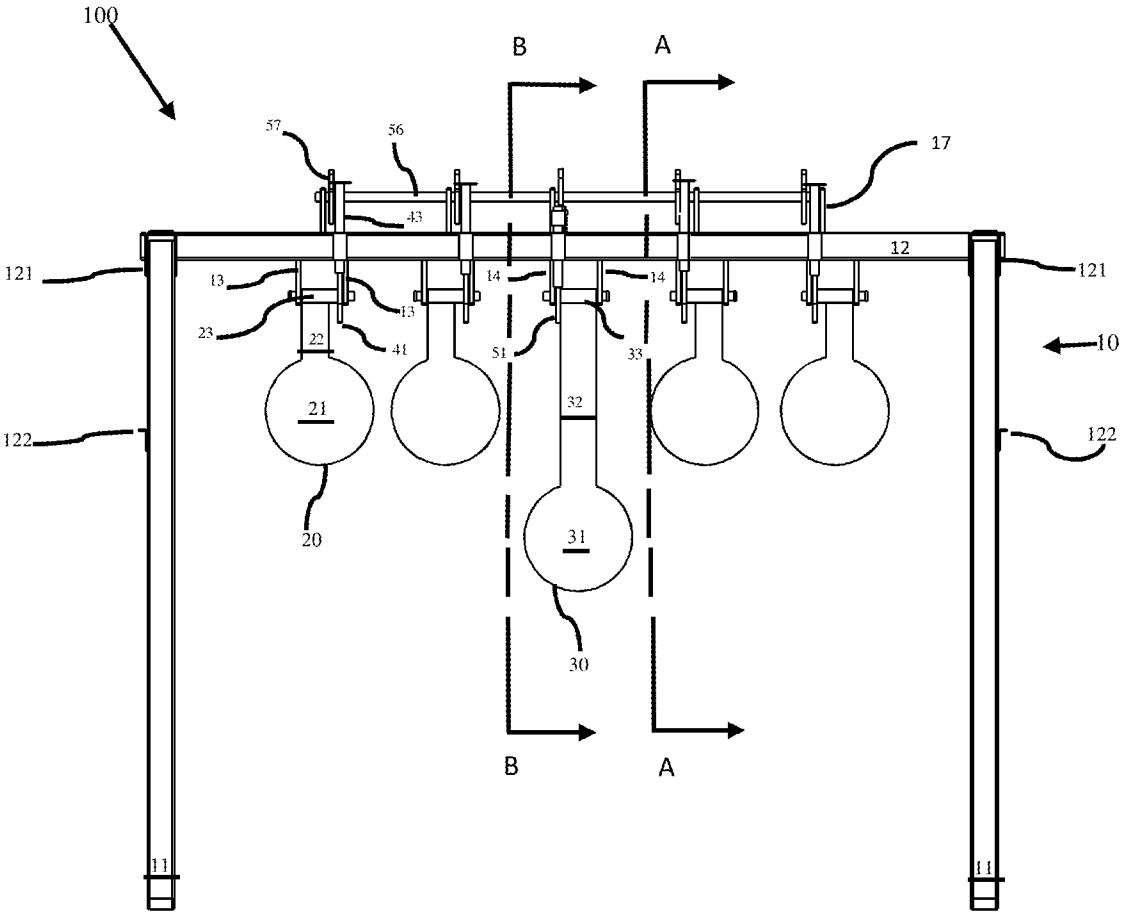
FIG. 1 is a rear view of a mechanical target system according to an embodiment of the present disclosure.
Figures 2A, 2B:
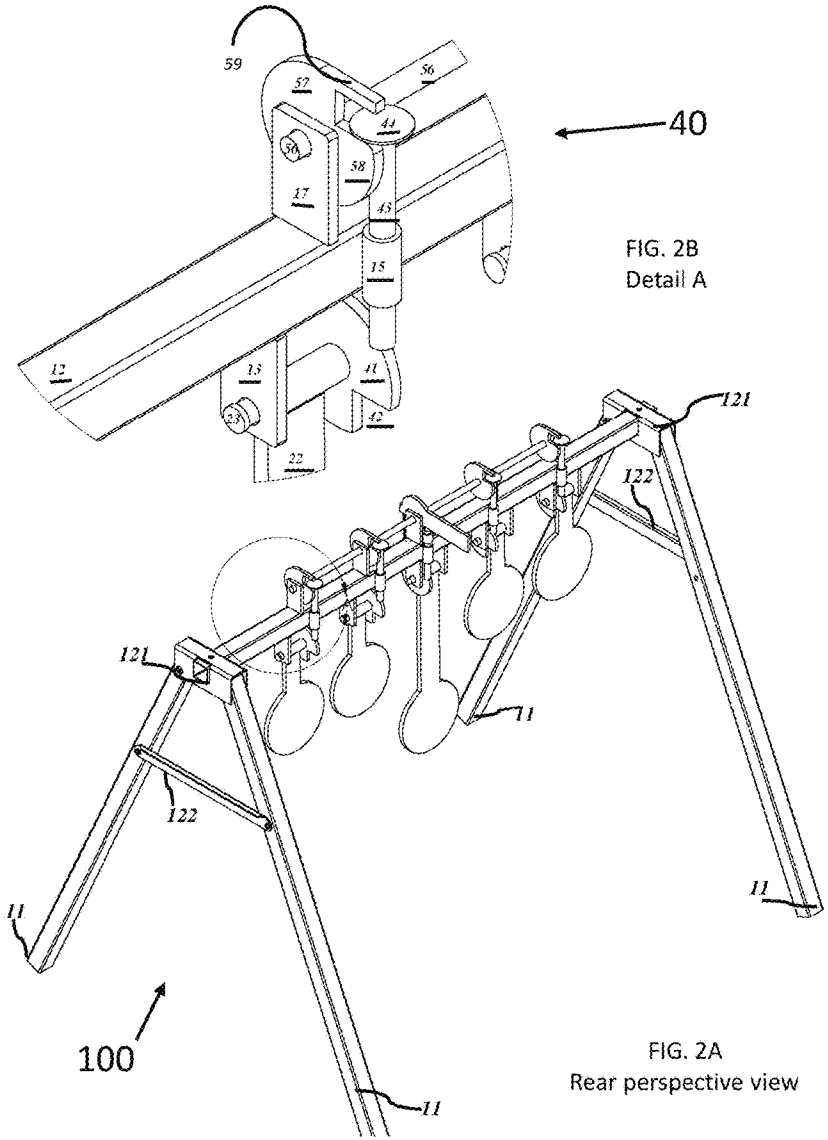
FIG. 2A is a rear perspective view of a mechanical target system according to an embodiment of the present disclosure.
FIG. 2B is a detail view of the area A in FIG. 2A.
Figures 3A, 3B:
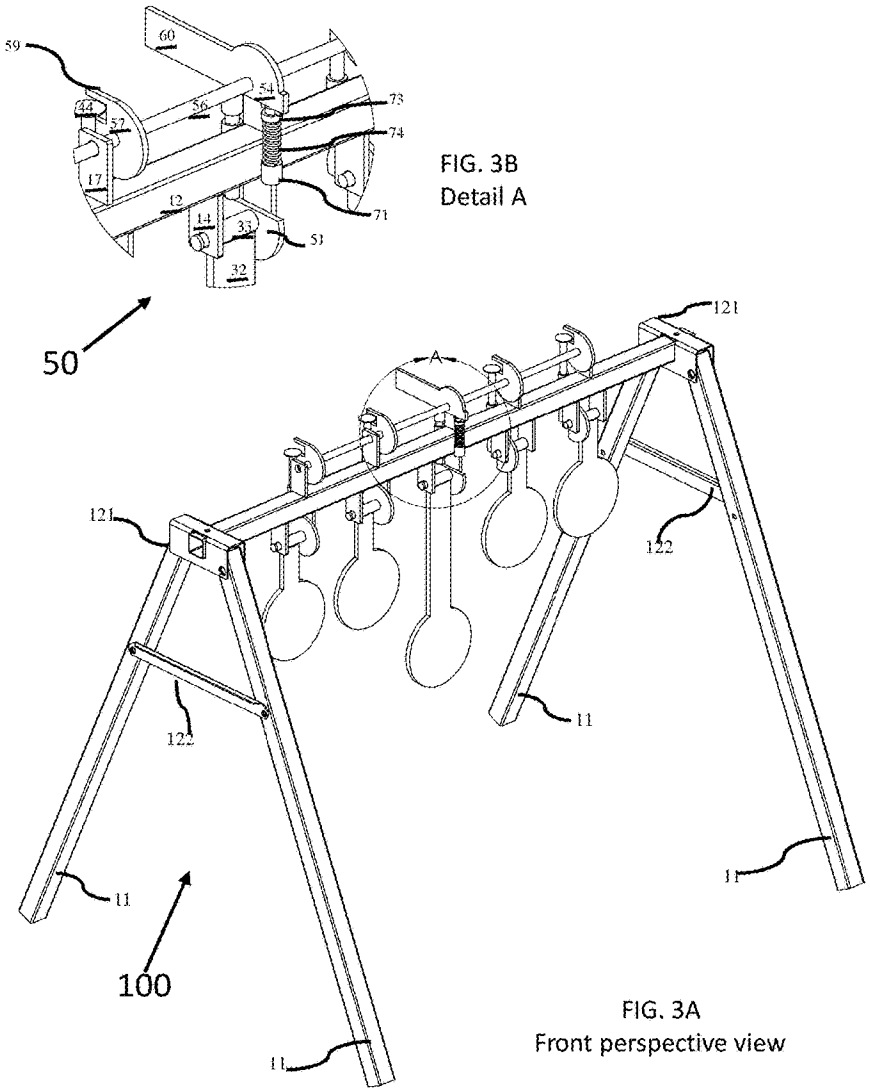
FIG. 3A is a front perspective view of a mechanical target system according to an embodiment of the present disclosure.
FIG. 3B is a detail view of the area A in FIG. 3A.

FIGS. 1, 2A, and 3A illustrate a target system 100 according to an embodiment of the present disclosure. The target system 100 may include a frame 10. The frame 10 may be configured to be placed on the ground or on a table. The frame 10 may include legs 11. For example, the frame 10 may include four legs 11. The frame 10 may further include a cross member 12. The frame 10 may further include connection brackets 121. The connection brackets 121 may be configured to receive and connect to the cross member 12 and the legs 11. For example, the cross member 12 may be received within a slot in the connection bracket 121, and the leg may be received within another slot in the connection bracket 121. In embodiments with four legs 11, each connection bracket 121 may receive two legs 11. The cross member 12 may be removable from the connection bracket 121 for ease of transport. The frame 10 may further include a leg locking bar 122. The leg locking bar 122 may be configured to improve the stability of the legs 11. For example, in embodiments with four legs 11, there may be two leg locking bars 122, with each leg locking bar 122 being rotatably connected to two legs 11. Therefore, the leg locking bars 122 may hold the legs 11 apart for stability, but may rotate to hold the legs 11 close for ease of transport.

The mechanical system 100 may include a target 20. The target 20 may be rotatably connected to the frame 10. For example, the target 20 may be rotatably connected to the cross member 12. The target 20 may include a target shaft 21. The target shaft 21 may allow the target 20 to be rotatably connected to the frame 10. The frame 10 may include a pair of target supports 13. The target shaft 21 may rotate within apertures within the pair of target supports 13. The pair of target supports 13 may be connected to the frame 10. For example, the pair of target supports 13 may be connected to the cross member 12, via a welded connection.

The target 20 may comprise a target face 22. The target face 22 may be the area at which a marksman shoots. The target face 22 may be a variety of shapes. In the specific embodiment shown in FIGS. 1, 2A, and 3A, the target face 22 is circular in shape. For example, the target face 22 may be 6 inches in diameter. The target face 22 may include images or markings to further define an area for the marksman to aim their shot.

The target 20 may further comprise a target arm 23. The target arm 23 may be substantially rectangular in shape. For example, the target arm 23 may be 4 inches long. The target face 22 may be connected to the target arm 23. The target face 22 and the target arm 23 may be formed integrally as one component, or be removably attachable to one another. The target arm 23 may be connected to the target shaft 21. For example, the target arm 23 may be welded to the target shaft 21. In other embodiments, the targer arm 23 may be removably attachable to the target shaft 21.

The target system 100 may further include a reset 30. The reset 30 may be rotatably connected to the frame 10. For example, the reset 30 may be rotatably connected to the cross member 12. The reset 30 may include a reset shaft 31. The reset shaft 31 may allow the reset 30 to be rotatably connected to the frame 10. The frame 10 may include a pair of reset supports 14. The reset shaft 31 may rotate within apertures within the pair of reset supports 14. The pair of reset supports 14 may be connected to the frame 10. For example, the pair of reset supports 14 may be connected to the cross member 12. For example, the pair of reset supports 14 may be welded to the cross member 12. In other embodiments, the reset supports 14 may be may be removably attachable to the the cross member 12.

The reset 30 may comprise a reset face 32. The reset face 32 may be the area at which a marksman shoots. The reset face 32 may be a variety of shapes. In the specific embodiment shown in FIGS. 1, 2A, and 3A, the reset face 32 is circular in shape. For example, the reset face 32 may be 6 inches in diameter. The reset face 32 may include images or markings to further define an area for the marksman to aim their shot.

The reset 30 may further comprise a reset arm 33. The reset arm 33 may be substantially rectangular in shape. For example, the reset arm 33 may be 8 inches or 10 inches long. The reset face 32 may be connected to the reset arm 33. The reset face 32 and the reset arm 33 may be formed integrally as one component. The reset arm 33 may be connected to the reset shaft 31. For example, the reset arm 33 may be welded to the reset shaft 31.

The reset 30 may be identifiable from the target 20. For example, the reset face 22 may be a different shape than the target face 32, or the reset 32 face may be higher or lower than the target face 22 relative to the ground.

The target 20 may be configured to have an unlocked position P1 and a locked position P2. The unlocked position P1 may include when the target 20 is facing the marksman. The locked position P2 may include when the target 20 is not facing the marksman. A target 20 may be considered to be facing the marksman if the target face 22 is perpendicular to the shot when marksman is aiming at the target system 100. The target 20 may be normally in the unlocked position P1. For example, the weight of the target 20 may cause the target 20 to naturally be facing the marksman. As discussed in further detail below, the target system 100 of the present disclosure may be configured such that when a target 20 is shot in the unlocked position P1, the target moves to the locked position P2.

Figure 4:
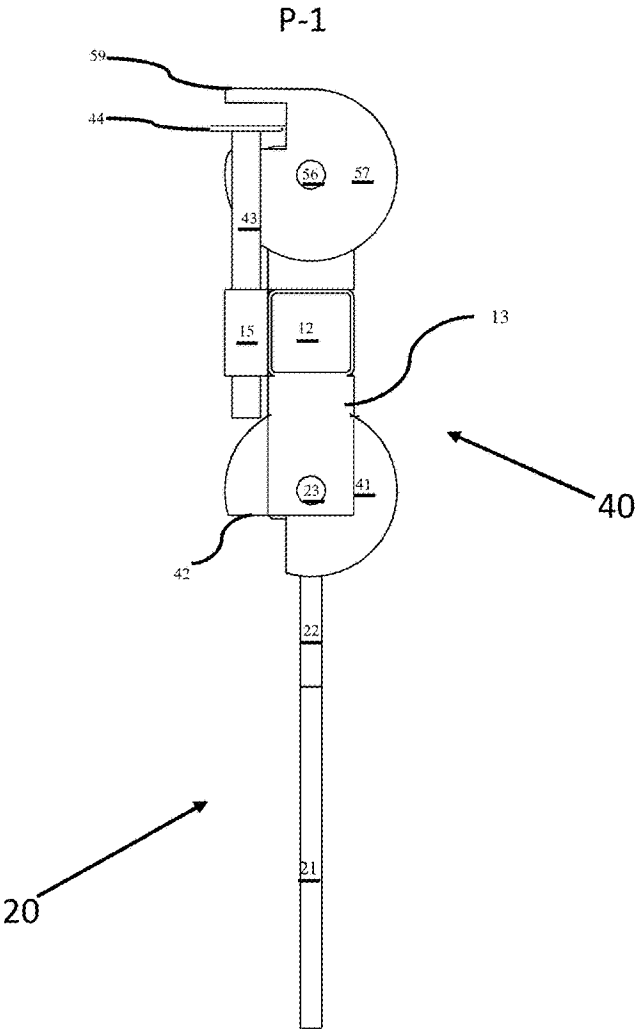
FIG. 4 is a sectional view taken along line A-A of FIG. 1 of an embodiment of the present disclosure, showing a target in an unlocked position.
Figure 5:
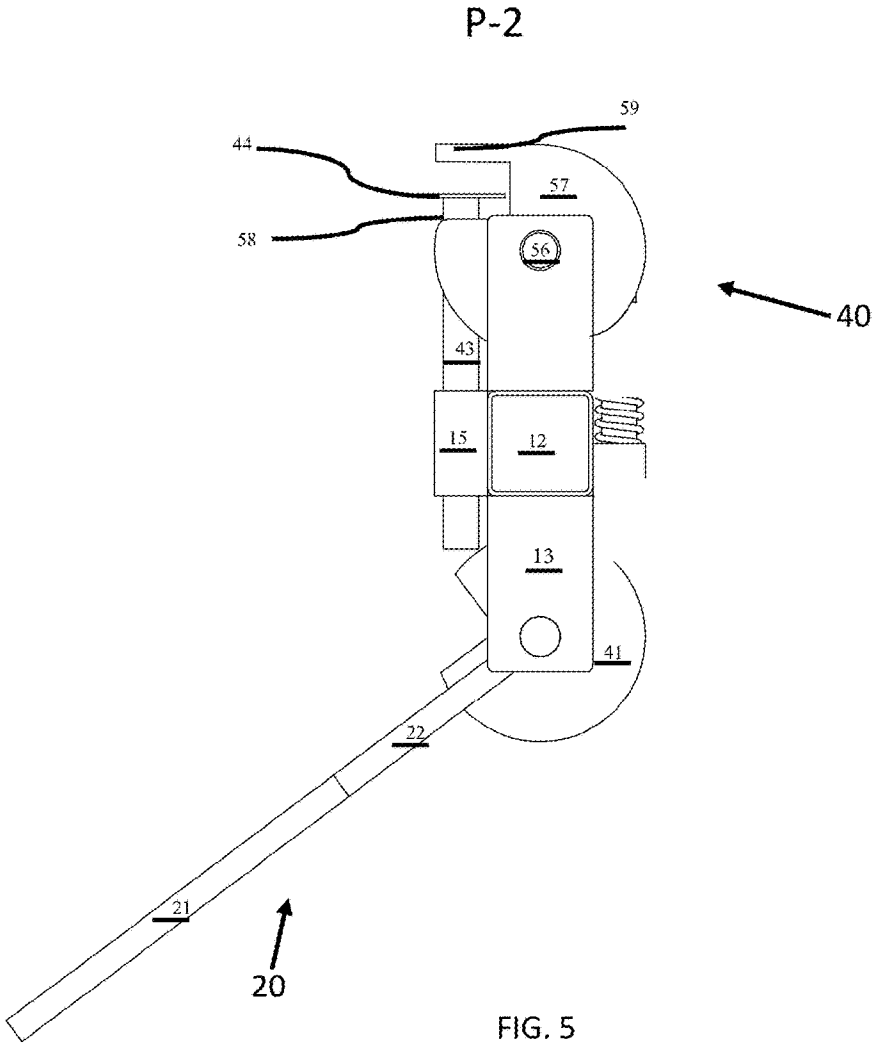
FIG. 5 is a sectional view taken along line A-A of FIG. 1 of an embodiment of the present disclosure, showing a target in a locked position.

The target system 100 may further include a locking system 40. The locking system 40 may be configured to hold the target 20 in the locked position P2. As shown in FIGS. 2B and 4-5, the locking system 40 may include a target cam 41. The target cam 41 may be connected to the target shaft 21. For example, the target cam 41 may be welded to the target shaft 21. The target cam 41 may be a snail/drop cam having a spiral peripheral shape. For example, the periphery may have a ending radius that is larger than the starting radius. Thus, the difference between the radii of the target cam 41 may define a blocking face 42. The locking system 40 may further include a target pin 43. The frame 10 may include a target pin sleeve 15. The target pin 43 may be slidably held within the target pin sleeve 15. The target pin sleeve 15 may be connected to the frame 10. For example, the target pin sleeve 15 may be connected to the cross member 12, via a welded connection. The target pin 43 may be configured to contact the target cam 41. For example, the target pin 43 may rest on the target cam 41 along the periphery. A shield (not shown) may be provided to shield the locking system to protect the locking system from being damaged by bullets or the like. The shield may be positioned in the front of the locking system (e.g. a frontal barrier), partially surround the locking system, or completely house the locking system (e.g. a frontal, top, side, and rear barrier).

In use, the target 20 can be rotated from the unlocked position of P1 by the force of the target 20 being hit (e.g. by a bullet). This can cause the target pin 43 to move along the periphery of the target cam 41. When the target 20 rotates beyond the point at which the target cam 41 has the largest radius (e.g. at 90°), the target pin 43 can drop to the periphery of the target cam 41 (e.g. the smallest radius of the cam). This drop can cause the blocking face 42 of the target cam 41 to contact the target pin 43, thereby stopping the target 20 from rotating to return to the unlocked position P1. At this point, the target 20 may be in the the locked position P2.

The mechanical target system 100 of the present disclosure may give the marksman a visual indication that the target 20 has been hit by moving the target 20 from the unlocked position P1 to the locked position P2.

Figure 6:
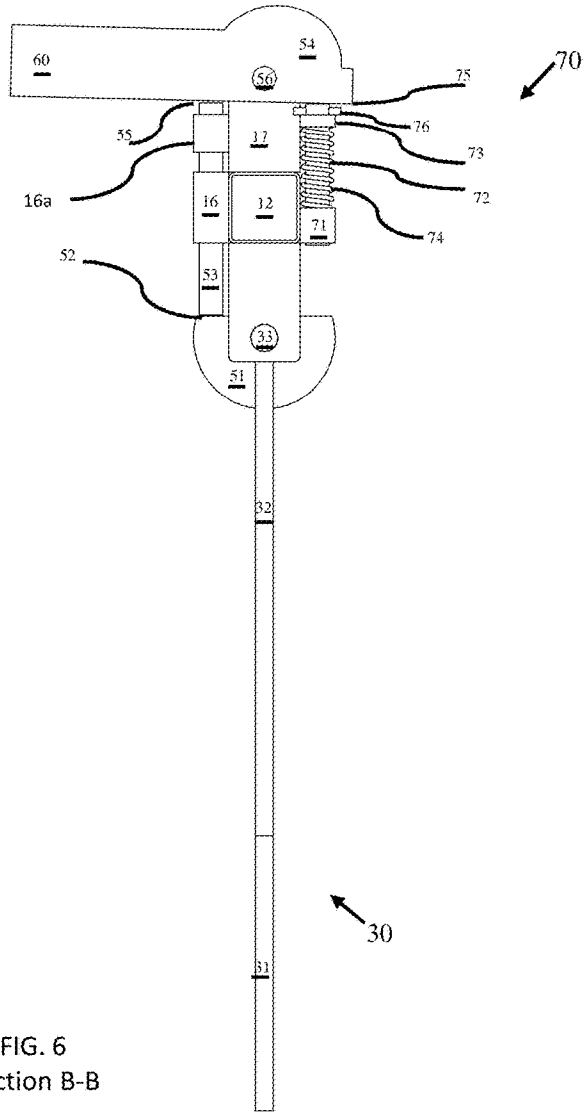
FIG. 6 is a sectional view taken along line B-B of FIG. 1 of an embodiment of the present disclosure.

The mechanical target system 100 may further include an unlocking system 50. The unlocking system 50 may be configured to release the target 20 from the locked position P2 and move the target 20 to the unlocked position P1. As shown in FIGS. 2B, 3B, and 6, the unlocking system 50 may include a reset cam 51. The reset cam 51 may be connected to the reset shaft 31. For example, the reset cam 51 may be welded to the reset shaft 31. The reset cam 51 may have a half circle shape. The flat side of the reset cam 51 may define a transmitting face 52. The unlocking system 50 may further include a release pin 53. The frame 10 may include a release pin sleeve 16. The release pin 53 may be slidably held within the release pin sleeve 16. The release pin sleeve 16 may be connected to the frame 10, via a welded connection. The release pin 53 may be configured to contact the transmitting face 52. When the reset 30 is rotated, for example when the reset 30 is hit, the reset cam 51 can lift the reset pin 53 due to the contact with the transmitting face 52.

The unlocking system 50 may include a release cam 54. The release cam 54 may have a half circle shape. The flat side of the release cam 54 may define a receiving face 55. The release pin 53 may be configured to contact the receiving face 55. When the release pin 53 is lifted by the reset cam 51, for example when the reset 30 is rotated due to contact with the transmitting face 52, the release cam 54 may also rotate due to contact with the receiving face 55.

The release cam 54 may be connected to a release shaft 56. For example, the release cam 54 may be welded to the release shaft 56. The release shaft 56 may extend parallel to and the length of the cross member 12. The release shaft 56 may be rotatably connected to the frame 10. The frame 10 may include two release supports 17. The release shaft 56 may rotate within apertures within the pair of release supports 17. The release supports 17 may be connected to the frame 10. For example, the release supports 17 may be connected to the cross member 12, via a welded connection. The frame 10 may further include more than two release supports 17. For example, the frame 10 may include a release support 17 for each target 20 in the mechanical target system 100. The release support 17 may include a release pin collar 16*a*. The release pin collar may be connected to the release support 17, via a welded connection. The release pin 53 may slide within the release pin collar 16*a*.

As shown in FIGS. 2B and 4-5, a target release cam 57 may be further connected to the release shaft 56. For example, the target release cam 57 may be welded to the release shaft 56. The target release cam 57 may be a snail/drop cam having a spiral peripheral shape. For example, the periphery may have a ending radius that is larger than the starting radius. The difference between the radii of the target release cam 57 may define a lifting face 58. When the target is in the locked position P2, a portion of the target pin 43 may rest on the lifting face 58. For example, the target pin 43 may include a target pin head 44 which rests on the lifting face 58. When the release shaft 56 is rotated, the target release cam 57 lifts the portion of the target pin 43 resting on the lifting face 58. Thus, the target pin 43 may lift above the blocking face 42 of the target cam 41, which may allow the target 20 to rotate to the unlocked position P1. In some embodiments, gravity may cause the target 20 to rotate to the unlocked position P1. It is also contemplated that the target 20 can be biased, for example via a spring, to rotate to the unlocked position P1.

The mechanical target system 100 of the present disclosure may allow a marksman to hit the reset 30 to move the target 20 from the locked position P2 to the unlocked position P1.

As shown in FIGS. 2B and 4-5, the target release cam 57 may further include a projection 59. The projection 59 may limit the vertical movement of the target pin 43. For example, the force of hitting the target 20 may cause the target pin 43 to eject out of the target pin sleeve 15, which is undesirable. Instead, the target pin 43 may hit the projection 59 and remain in the target pin sleeve 15.

As shown in FIGS. 3B and 6, the mechanical target system 100 of the present disclosure may further include a manual reset 60. The manual reset 60 may be a lever. The manual reset 60 may be connected to the release cam 54. For example, the manual reset 60 may be welded to the release cam 54. The manual reset 60 may alternatively be connected to the release shaft 56, such as with a welded connection. The marksman may lift the manual reset 60 to rotate the release shaft 56 to move the target 20 from the locked position P2 to the unlocked position P1. The manual reset 60 may allow the marksman to move the target 20 from the locked position P2 to the unlocked position P1 without needing to hit the reset 30, for example, without needing to shoot the reset 30.

The mechanical target system 100 of the present disclosure can further include a tension system 70. The tension system 70 may provide a bias against the rotation of the release shaft 56. The tension system 70 may thereby reduce the possibility of accidentally moving other targets 20 from the locked position P2 to the unlocked position P1, for example, by a target 20 being hit. For example, the target pin 43 may hit the projection 59 of the target release cam 57, which can cause rotation of the release shaft 56 and rotate the other target release cams 57. If this were to occur, the other target pins 43 would be unintentionally lifted to move all targets to the unlocked position P1, instead of remaining in the locked position P2. Therefore, the tension system 70 can provide a bias against the rotation of the target release cam 57 when the projection 59 is hit by the target pin.

The tension system 70 may comprise a first tension sleeve 71 connected to the frame 10. For example, the first tension sleeve 71 may be connected to the cross member 12. For example, the first tension sleeve 71 may be welded to the cross member 12. The tension system 70 may further comprise a tension pin 72. The tension pin 72 may be slidably held within the first tension sleeve 71. The tension system 71 may further comprise a second tension sleeve 73. The second tension sleeve 73 may be arranged coaxial with the first tension sleeve 71 and tension pin 72. The tension system 71 may further comprise a tension spring 74. The tension spring 74 may be arranged coaxial with the first tension sleeve 71, tension pin 72, and second tension sleeve 73. The tension pin 72 may be slidably held within the tension spring 74. The tension spring 74 may be arranged such that a lower end rests on an upper end of the first tension sleeve 71 and an upper end rests on a lower end of the second tension sleeve 73. The tension pin 72 may be held fixed relative to the second tension sleeve by a retaining pin 75. The release cam 54 may further include a pressing face 76. The pressing face may be in contact with the tension pin 72. When the release cam 54 is rotated, it can push the tension pin 72 via the pressing face, against the bias of the tension spring 74. The bias will increase the force required to rotate the release shaft 56. Therefore, if the target pin 43 hits the projection 59 of the target release cam 57, the force may not be enough to rotate the release shaft 56 to move the targets 20 from the locked position P2 to the unlocked position P1 accidentally.

The mechanical target system 100 may include a plurality of targets 20. In the specific embodiment shown in FIGS. 1, 2A, and 3A, the mechanical target system 100 includes four targets 20. The targets 20 may be equally spaced along the length of the cross member 12. For example, the targets 20 may be spaced 16 inches apart. Each of the plurality of targets 20 may include a locking system 40. For example, each of the plurality of targets 20 may be moved from an unlocked position P1 to a locked position P2 individually. The unlocking system 50 may include a target release cam 57 for each target 20 connected to the release shaft 56. For example, the plurality of targets 20 may be moved uniformly from the locked position P2 to the unlocked position P1 by hitting the reset 30. The plurality of targets 20 may be arranged such that a marksman may need to adjust their aim in order to shoot each target 20. For example, the plurality of targets 20 may be arranged in a row. The reset 30 may be positioned in the arrangement for ease of identification. For example, the reset 30 may be positioned centrally in the arrangement or at one end of the arrangement.

FIG. 7 details exemplary dimensions and materials for various components of a specific embodiment of the mechanical target system 100. The materials chosen allow the target system 100 to be used will a variety of grains of ammunition. For example, 9 mm may be the smallest ammunition used, and armor piercing rounds may be the largest ammunition used. The target system 100 may be designed to function for this range of ammunition as well as reduce permanent damage, while ensuring safety for the marksman. For example, the targets 20 and the reset 30 may be made of AR-555 Ballistic material.

Figure 8:
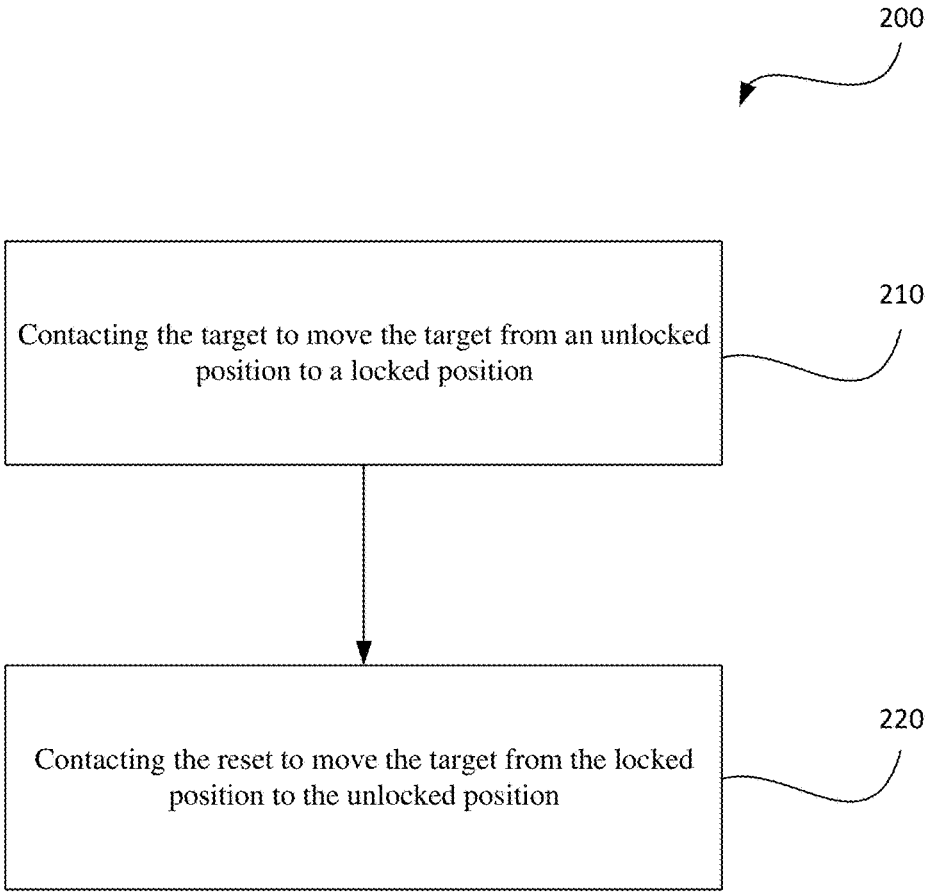
FIG. 8 is a flowchart for a method according to an embodiment of the present disclosure.
Figure 9:
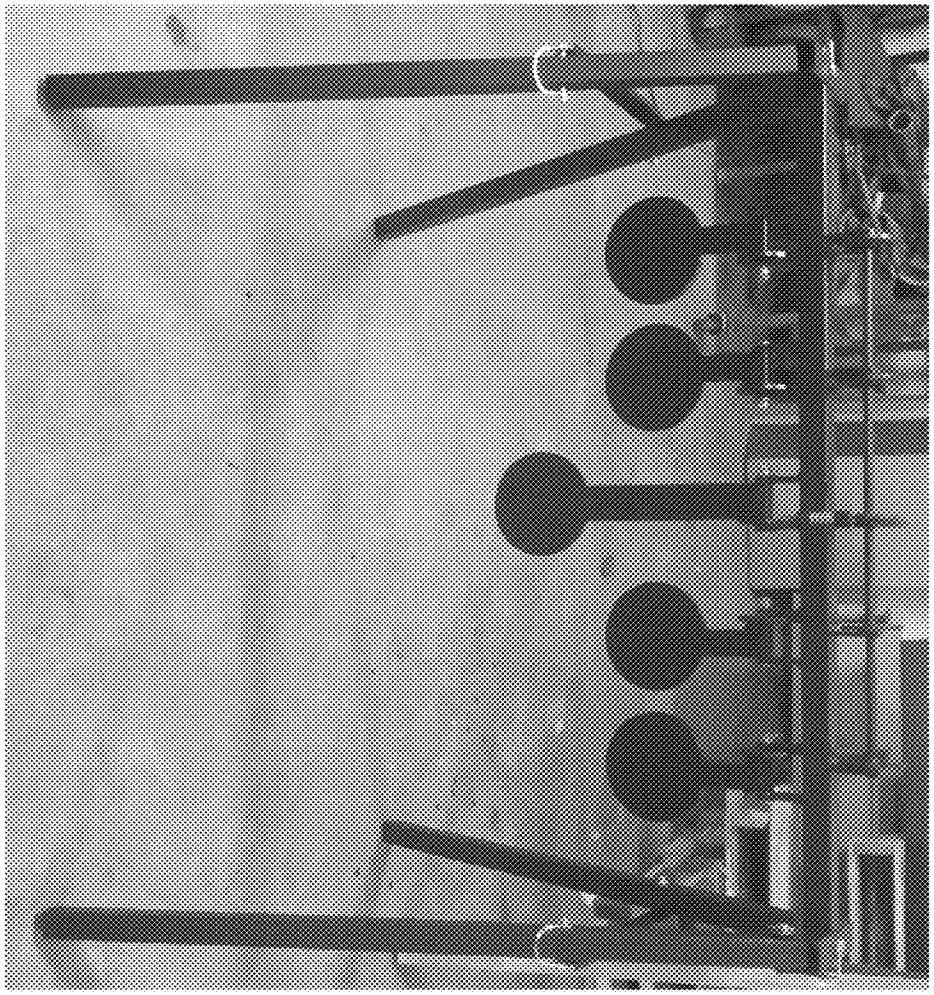
FIG. 9 is a photograph of a front view of a prototype of the present disclosure, showing the targets in an unlocked position.
Figure 10:
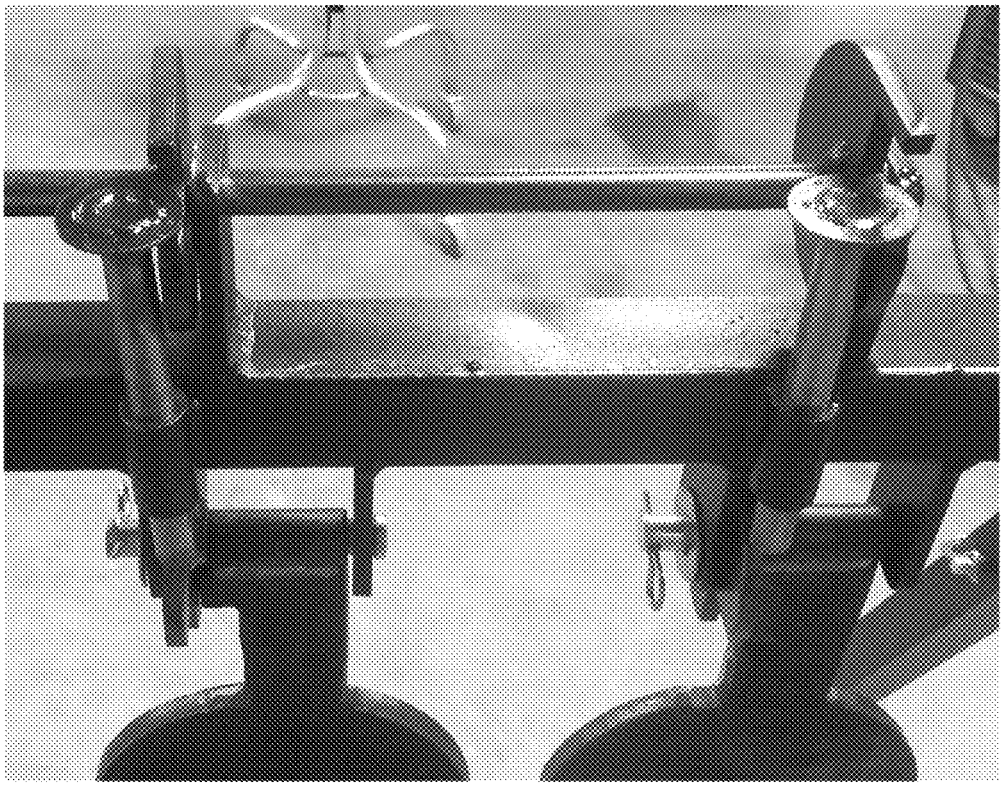
FIG. 10 is a photograph of a rear view of a prototype of the present disclosure, detailing the locking/unlocking systems of the targets.
Figure 11:
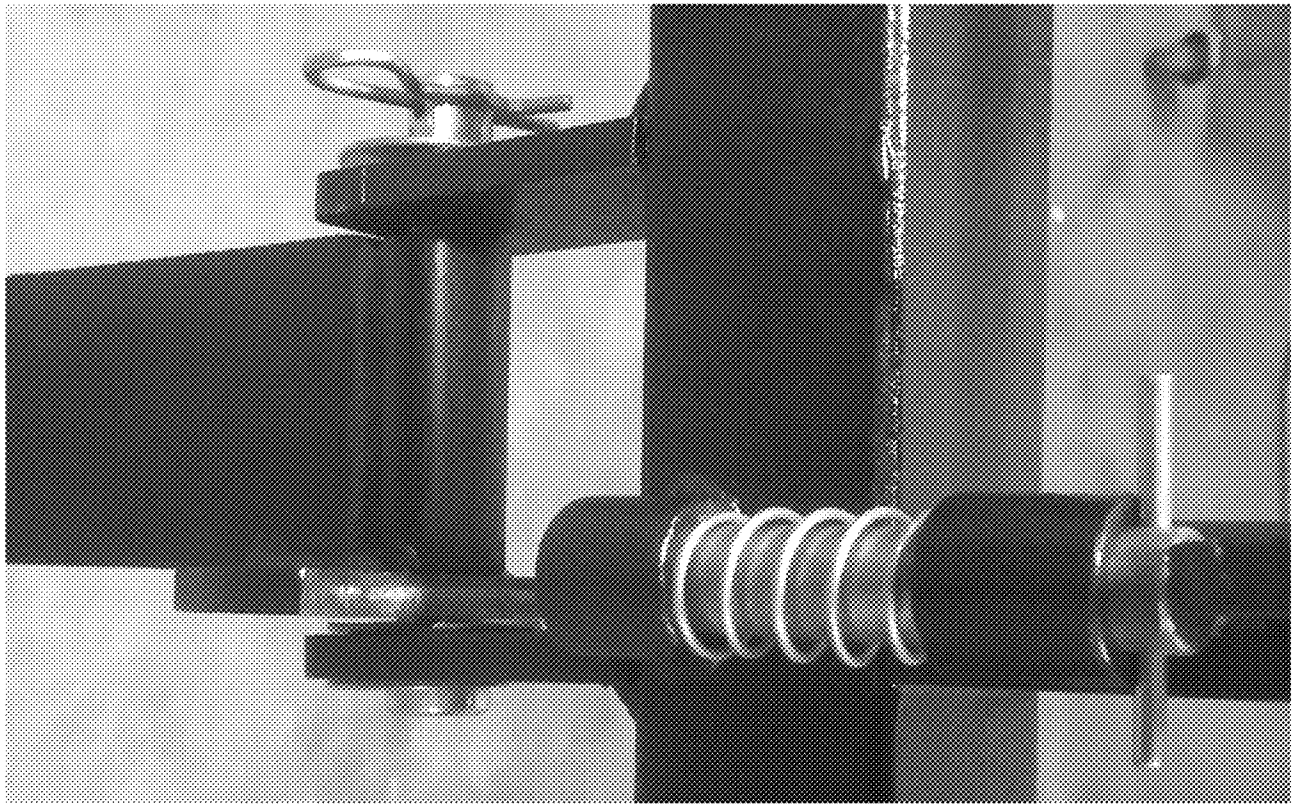
FIG. 11 is a photograph of a front view of a prototype of the present disclosure, detailing the tensioning system.
Figure 12:
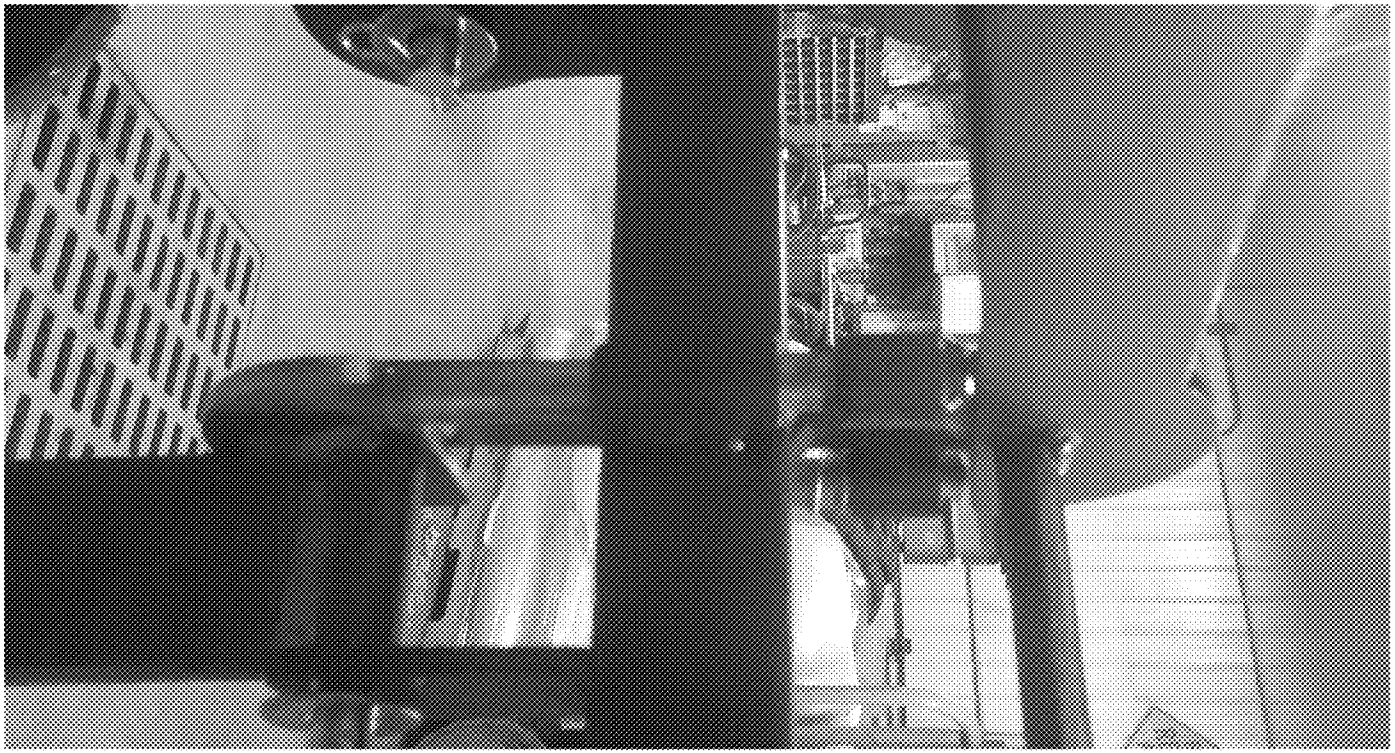
FIG. 12 is a rear perspective view of a prototype of the present disclosure, detailing the unlocking system of the reset.
Figure 13:
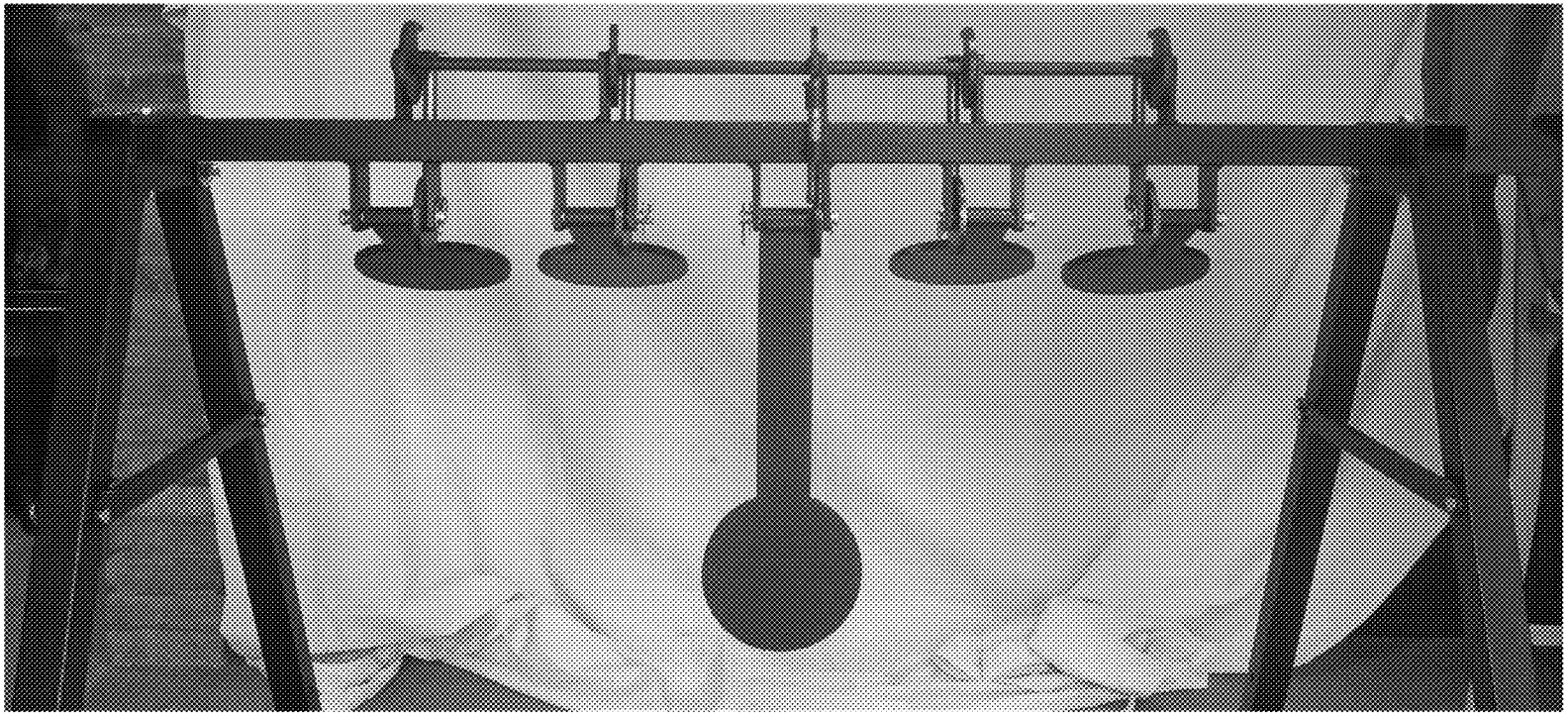
FIG. 13 is a front view of a prototype of the present disclosure, showing the targets in a locked position.
Figure 14:
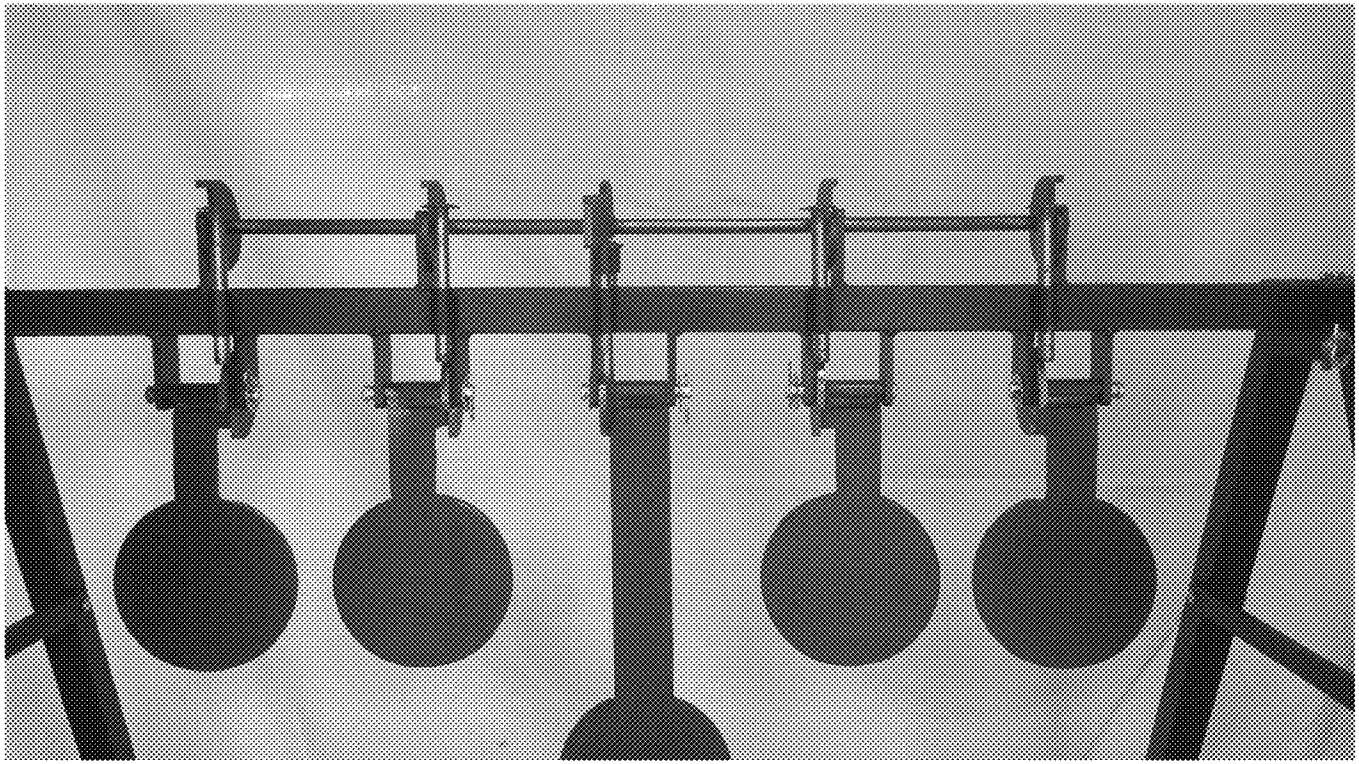
FIG. 14 is a photograph of a prototype of the present disclosure, showing the targets in an unlocked position.
Figure 15:
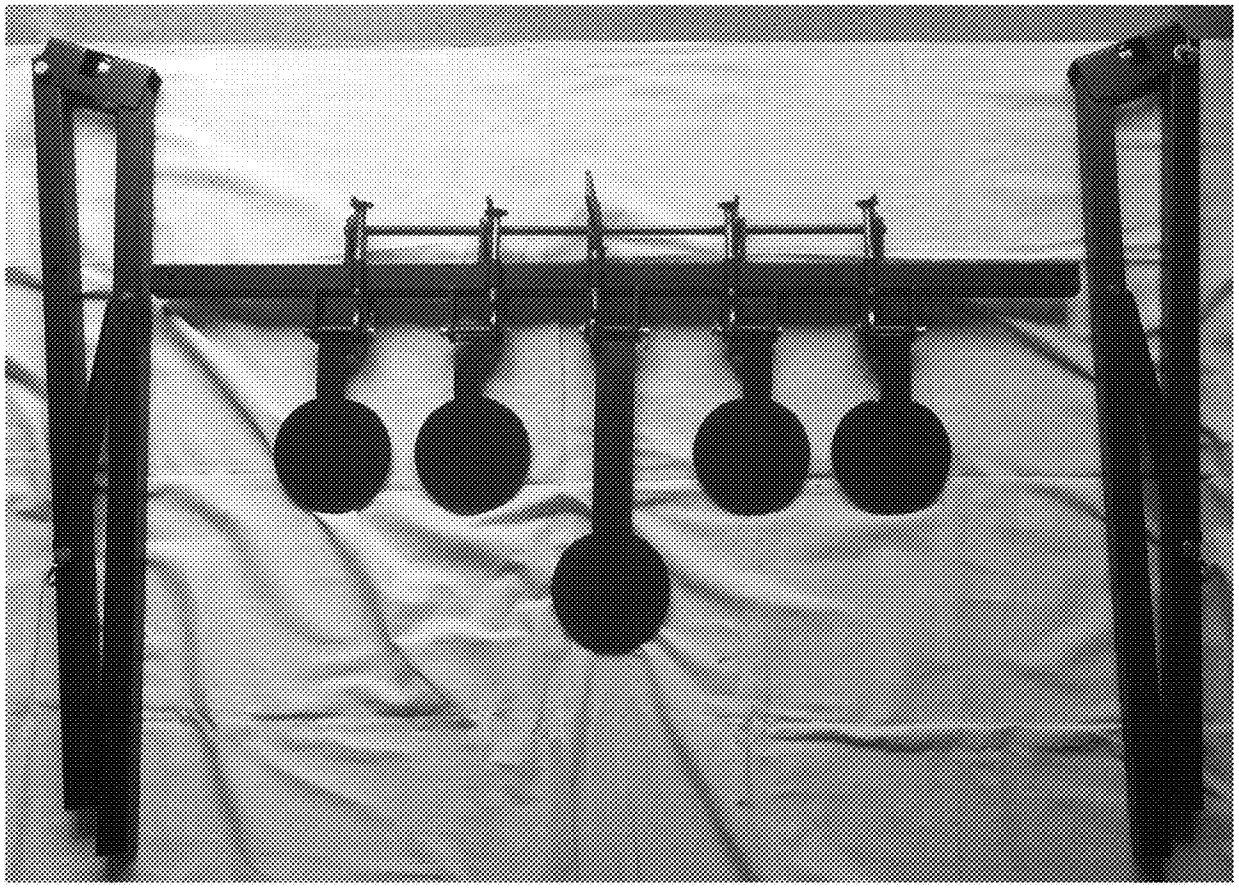
FIG. 15 is a photograph of a prototype of the present disclosure, showing the legs disassembled from the cross member.
Figure 16:
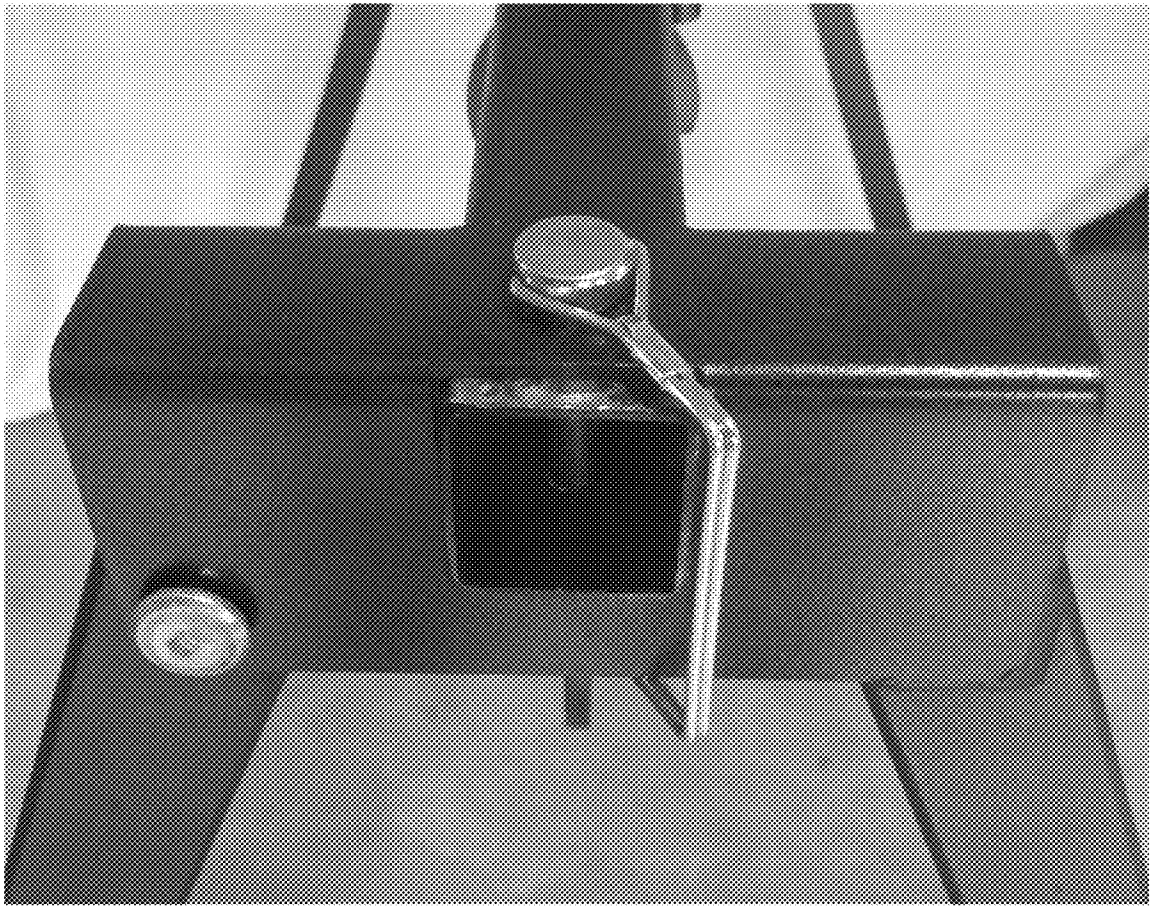
FIG. 16 is a side perspective view of a photograph of a prototype of the present disclosure, detailing the connection bracket.

The mechanical target system 100 of the present disclosure may further define a method 200 of utilizing the system 100. The method 200, shown in FIG. 8, may comprise:

Contacting 210 the target to move the target from an unlocked position to a locked position. A marksman may contact the target with a bullet shot by a gun at the target. By contacting the target, the target shaft and target cam may rotate. The target pin resting on the target cam may move along the periphery of the target cam during rotation until it drops to contact the blocking face. The target pin will stop the target cam from rotating due to the contact with the blocking face, and the target will remain in a locked position.

Contacting 220 the reset to move the target from the locked position to the unlocked position. A marksman may contact the reset with a bullet shot by a gun at the reset. By contacting the reset, the reset shaft and reset cam may rotate. The reset pin resting on the transmitting face of the reset cam may lift when the reset cam is caused to rotate. The reset pin may contact the receiving face of the release cam, which may cause the release cam, release shaft, and target release cam to rotate. The lifting face of the target release cam may contact the target pin and lift the target pin from contact with the blocking face when the target release cam is rotated, and the target will move to the unlocked position.

FIGS. 9-16 are photographs of a prototype of the present disclosure. The prototype depicted is intended to be exemplary, and in no way limit the scope of the present disclosure.

Although the present disclosure has been described with respect to one or more particular embodiments, it will be understood that other embodiments of the present disclosure may be made without departing from the spirit and scope of the present disclosure.

What is claimed is:

1. A mechanical target system comprising:
a frame;
a target rotatably connected to the frame;
a reset rotatably connected to the frame;
a locking system configured to hold the target in a locked position; and
an unlocking system configured to release the target from the locked position;
a target pin sleeve connected to the frame;
wherein the target pin is slidable within the target pin sleeve;
wherein contacting the target moves the target from an unlocked position to the locked position;
wherein contacting the reset moves the target from the locked position to the unlocked position;
wherein the target comprises:
a target shaft rotatably connected to the frame;
a target arm connected to the target shaft; and
a target face connected to the target arm;
wherein the locking system comprises:
a target cam connected to the target shaft; and
a target pin contacting the target cam;
wherein the target cam includes a blocking face configured to stop the rotation of the target shaft when the target pin contacts said blocking face.

2. The mechanical target system of claim 1, wherein the frame comprises:
a cross member; and
legs connected to the cross member.

3. The mechanical target system of claim 1, wherein the frame further comprises a pair of target supports configured to rotatably connect the target shaft to the frame via a pair of apertures.

4. The mechanical target system of claim 1, wherein the reset comprises:
a reset shaft rotatably connected to the frame;
a reset arm connected to the target shaft; and
a reset face connected to the target arm.

5. The mechanical target system of claim 4, wherein the frame further comprises a pair of reset supports configured to rotatably connect the reset shaft to the frame via a pair of apertures.

6. The mechanical target system of claim 4, wherein the unlocking system comprises:
a release shaft rotatably connected to the frame;
a reset cam connected to the reset shaft;
a release cam connected to the release shaft;
a target release cam connected to the release shaft; and
a reset pin contacting the reset cam and the release cam;
wherein the reset cam includes a transmitting face, the release cam includes a receiving face, and the reset pin contacts the transmitting face and the receiving face;
wherein rotation of the reset shaft lifts the reset pin, which rotates the release cam, rotates the release shaft, and rotates the target release cam;
wherein the target release cam includes a lifting face and the target pin contacts the lifting face; and
wherein rotation of the target release cam lifts the target pin from contacting the blocking face.

7. The mechanical target system of claim 6, wherein the frame further comprises a pair of release supports configured to rotatably connect the release shaft to the frame via a pair of apertures.

8. The mechanical target system of claim 6, wherein rotation of the release shaft is performed by contacting the reset.

9. The mechanical target system of claim 8, wherein the unlocking system uniformly releases all of the targets from the locked position to the unlocked position.

10. The mechanical target system of claim 6, further comprising a manual reset connected to the release cam, wherein the rotation of the release shaft is performed by lifting the manual reset.

11. The mechanical target system of claim 1, wherein the system comprises a plurality of targets and a plurality of locking systems.

12. A mechanical target system comprising:
a frame;
a target rotatably connected to the frame;
a reset rotatably connected to the frame;
a locking system configured to hold the target in a locked position; and
an unlocking system configured to release the target from the locked position;
wherein contacting the target moves the target from an unlocked position to the locked position;
wherein contacting the reset moves the target from the locked position to the unlocked position;
wherein the target comprises:
a target shaft rotatably connected to the frame;
a target arm connected to the target shaft; and
a target face connected to the target arm;

wherein the frame further comprises a pair of target supports configured to rotatably connect the target shaft to the frame via a pair of apertures.

13. A mechanical target system comprising:

a frame;

a target rotatably connected to the frame;

a reset rotatably connected to the frame;

a locking system configured to hold the target in a locked position; and an unlocking system configured to release the target from the locked position;

wherein contacting the target moves the target from an unlocked position to the locked position;

wherein contacting the reset moves the target from the locked position to the unlocked position;

wherein the target comprises:

a target shaft rotatably connected to the frame;

a target arm connected to the target shaft; and a target face connected to the target arm;

wherein the locking system comprises:

a target cam connected to the target shaft; and a target pin contacting the target cam;

wherein the target cam includes a blocking face configured to stop the rotation of the target shaft when the target pin contacts said blocking face;

wherein the reset comprises:

a reset shaft rotatably connected to the frame;

a reset arm connected to the target shaft; and a reset face connected to the target arm.

* * * * *